US006109608A

United States Patent [19]

Golad

[11] Patent Number: 6,109,608

[45] Date of Patent: Aug. 29, 2000

[54] PLAYING DICE

[76] Inventor: Adar Golad, Scherenenkweg 16, 8051 Kh Hattem, Netherlands

[21] Appl. No.: 09/068,649

[22] PCT Filed: Nov. 1, 1996

[86] PCT No.: PCT/NL96/00430

§ 371 Date: Sep. 2, 1998

§ 102(e) Date: Sep. 2, 1998

[87] PCT Pub. No.: WO97/18869

PCT Pub. Date: May 29, 1997

[30] Foreign Application Priority Data

Nov. 17, 1995 [NL] Netherlands ..... 1001678

[51] Int. Cl.[7] ..... A63F 9/04

[52] U.S. Cl. ..... 273/146; D21/372

[58] Field of Search ..... 273/146, 145 CA; D21/372, 373

[56] References Cited

U.S. PATENT DOCUMENTS

| | | | |
|---|---|---|---|
| 3,198,523 | 8/1965 | Stimson | 273/146 |
| 3,905,603 | 9/1975 | Hoetzel | 273/146 |
| 3,954,269 | 5/1976 | Brittingham | 273/138 R |
| 4,345,761 | 8/1982 | China | 273/146 |
| 4,635,938 | 1/1987 | Gray | 273/274 |
| 4,890,845 | 1/1990 | Gatewood | 273/271 |
| 5,018,738 | 5/1991 | Padi | 273/146 |
| 5,114,147 | 5/1992 | Faylo | 273/146 |

FOREIGN PATENT DOCUMENTS

| | | |
|---|---|---|
| 418935 | 2/1967 | Switzerland . |
| 511042 | 8/1971 | Switzerland . |
| 2144999 | 3/1985 | United Kingdom . |

*Primary Examiner*—Benjamin H. Layno
*Attorney, Agent, or Firm*—Ladas & Parry

[57] ABSTRACT

A die or dice is provided having an outer surface with four faces. The faces are arranged contiguously so as to form a single generally spherical body. Each face has at least in part the shape of a segment of a sphere and carries identifying indicia. The center of each face is located on the angular points of a symmetrical tetrahedron. Any three of the four faces, which faces are situated mutually in pairs adjacent one another, touch one another at a trihedral point. The trihedral point is situated diametrically with regard to the fourth face. The die is provided on its outer surface with four support positions. Each support position has as a center the trihedral point.

6 Claims, 4 Drawing Sheets

PLAYING DICE

BACKGROUND OF THE INVENTION

The present invention relates to a piece, such as a dice or a playing dice, provided with an outer surface with four faces, each face carrying an identifying index.

Suchlike pieces have been used for centuries for playing dice and other games and can, for instance, have any number of different shapes, such as described in the book "Oog in oog" (Eye in eye) by Leo van der Heydt, published in 1990 (ISBN 9060107063). On pages 76 and 77 of this book, pieces with four faces are described, for example, which were already in existence in 3000 BC. In the course of time suchlike pieces with four faces became, however, the least popular, because these pieces hardly roll.

SUMMARY OF THE INVENTION

It is an object of the present invention to provide a piece with four faces which is easily rollable, as a result of which the use thereof in dice or other games becomes attractive.

In order to achieve this aim according to the invention a piece is provided, such as a dice or a playing dice, provided with an outer surface with four faces, each face having at least in part the shape of a segment of a sphere and carrying identifying idica, the center of each face being located on the angular points of a symmetrical tetrahedron, in each case three of the four faces, which are situated mutually in pairs adjacent one other, touching one other at a trihedral point, which is situated diametrically with regard to the fourth face, and provided on the outer surface with four support positions for the piece, each support position having as a center a trihedral point. Because each face has at least in part the shape of a segment of a sphere, this piece can roll extremely well, whilst the support positions ensure that after rolling the piece one of the faces is facing upwards. Spherical dice are known per se, they have no support positions on their outer surface, however, and always have another number of identifying indicia than four.

Although in most cases the support positions support the piece sufficiently, when using the piece according to the present invention in a train or aeroplane, for instance, jolts or the like can lead to undesirable rolling of the piece. In order co avoid this undesirable rolling, the piece according to an embodiment of the present invention is further provided with an inner cavity, the piece having an inner surf ace, and with a separate stability-enhancing element, which is movably placed in the inner cavity, the inner surface defining the inner cavity and being provided with receiving means for receiving the stability-enhancing element in a number of stable positions, the number of stable positions being equal to the number of faces, and each stable position being diametrically situated with regard to the face in question. The stability awarded the piece by the support position can be enhanced such by the stability-enhancing element, which can be a small metal ball, for example, that even on a bumpy surface the piece can retain the occupied position. Hollow, spherical dice with a stability-enhancing metal ball are known per se, such as described for instance in the German patent specification 488.334 (page 1, lines 12 to 32). However, on account of the inner ball this known dice wobbles and the dice moves back and forth around its resting position for a while after rolling, so that the player casting the dice has to read the indices whilst the dice is still in motion.

The support positions are formed in a simple fashion by intersecting, slot-shaped recesses on the trihedral points, which separate the faces from each other, or by flat faces formed on the piece.

The piece according to the present invention cannot only be used as a dice but also as a playing dice for playing games such a draughts, go, othello and the like. For this purpose the present invention also provides an assembly of a games' board with a first number of playing surfaces and a second number of playing dice, the playing dice being in accordance with the present invention, and each playing surface containing a recess for rotatingly and retainingly receiving a playing dice. Such an assembly is moreover very suitable as travel game because when the playing dice are rotated in a certain position they remain in that position in spite of the occurrence of jolts and the like.

If the recesses have the shape of a segment of a sphere, a symmetrical tetrahedron or a cone it is possible to receive playing dice with different diameters in a stable way.

The invention also relates to a games' board with a number of playing surfaces, each playing surface being provided with a recess in the shape of either a segment of a sphere or a symmetrical tetrahedron or a cone. Such a games' board is extremely suitable for receiving playing dice of different dimensions and shapes. The invention also provides an assembly of a games' board with a number of playing surfaces and an equal number of playing dice, and the playing dice being dice according to the invention, each playing dice containing a recess for rotatingly and and retainably receiving a playing dice, in which the playing dice cannot fall out of the games, board. On account of the access openings it is possible to rotate the playing dice in a certain position.

BRIEF DESCRIPTION OF THE DRAWINGS

By way of example some embodiments of a piece, an assembly and a games' board according to the invention will be shown in the drawing.

DESCRIPTION OF THE PREFERRED EMBODIMENTS

Figure 1:
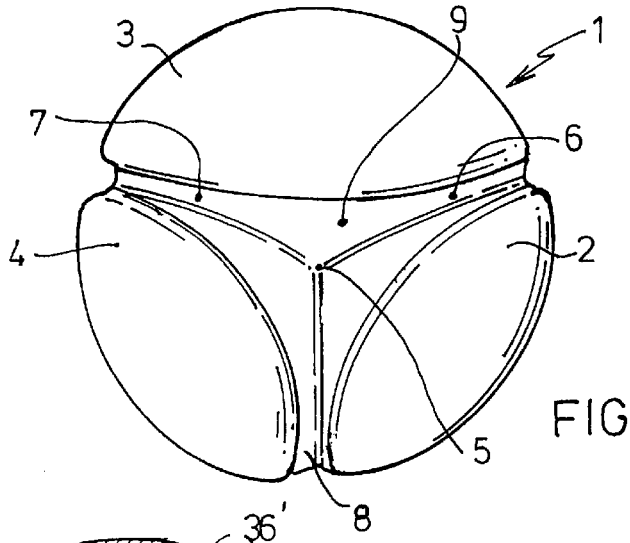
FIG. 1 shows a view of a first exemplary embodiment of a piece according to the invention.

In FIG. 1 a view of a piece 1 to be used as dice or playing dice is shown. The piece 1 has an outer surface with four faces, three of which 2, 3 and 4 can be seen in FIG. 1. Each face has at least in part the shape of a segment of a sphere, so that the piece can be rolled extremely well. Each face carries an identifying indicia, such as, for example, a numeral, a letter, a picture or a number of dots. The indicia is preferably a color, so that the index facing upwards is, for example, on the one hand easily recognizable and on the other the piece can also contain a neutral color which does not belong to the player.

Figure 2:
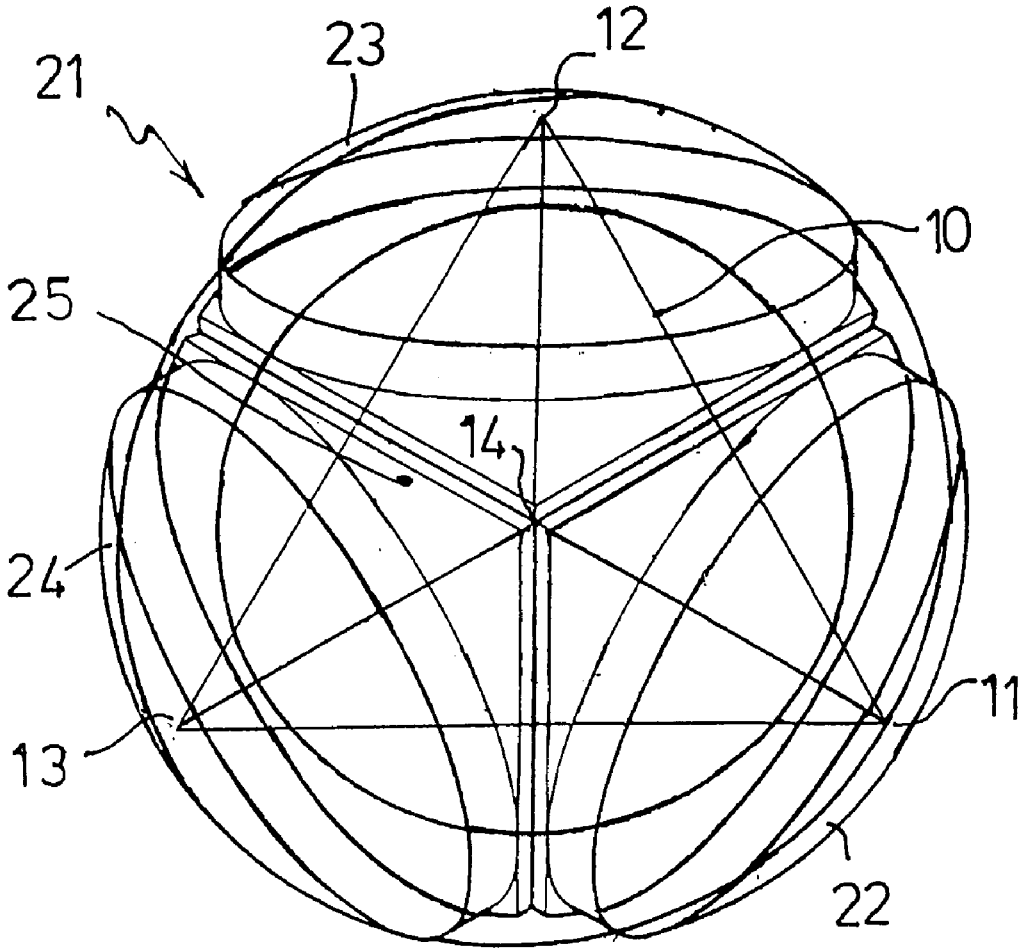
FIG. 2 shows a wire model of the piece according to FIG. 1.

In FIG. 2 a wire model 21 of the piece of FIG. 1 is shown, from which can be clearly seen that the center of each face 22, 23, 24 and 25 is situated on the angular points 11, 12, 13 and 14, respectively, of a symmetrical tetrahedron 10.

Because the center of each face of the piece 1 is situated on the angular points of a symmetrical tetrahedron, the piece can be configured such that it rolls evenly and in all directions. In each case three of the four faces (in FIG. 1 the faces 2, 3 and 4) of the piece 1 are situated mutually in pairs adjacent one another in these faces (2, 3 and 4) and touch one another at a trihedral point 5, which is situated diametrically with regard to the fourth face. On the outer surface the piece 1 is provided with support positions for the piece, each support position having as a center a trihedral point. An easily manufactured support position is a flat surface formed on the piece. In the embodiment that is shown in FIG. 1 each support position, —one support position can be seen in FIG. 1—, is formed by the intersection of intersecting, slot-shaped resses (6 , 7 and 8 are shown) which separated the faces (2, 3, 4 are shown) from one another. These intersections can be designed as desired, in order to obtain a supporting effect provided thereby.

If such a many-sided piece according to the invention is thrown, the latter will easily roll and will eventually come to a standstill at a support position so that the face diametrically opposite that support position will be visible to the player throwing the piece.

Figure 3:
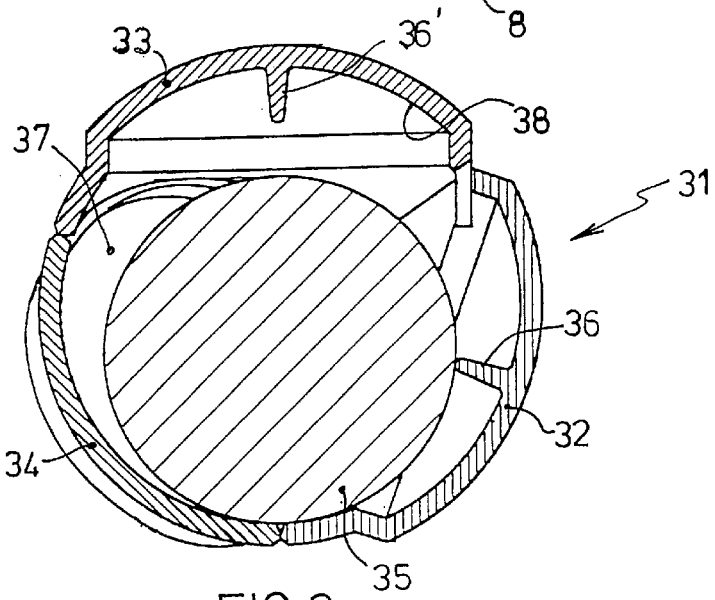
FIG. 3 shows a cross section of a second exemplary embodiment of a piece according to the invention.

In order to award the piece 31 more stability, the piece 31 is provided according to an embodiment of the invention as shown schematically in cross section in FIG. 3 with an inner cavity 37 so that the piece 31 has an inner surface 38. In the inner cavity 37 a separate stability-enhancing element, in this example a metal ball 35, is placed. On account of a number of receiving means 36, 36', the ball 35 can be received in a number of stable positions, each position being situated diametrically with regard to a particular face. In the example shown in FIG. 3 the receiving means are formed by three projections (two of which, 36, 36' can be seen), although alternatively resting hollows for the ball can be arranged in the inner surface. Owing to the weight of the stability-enhancing element, a piece resting in a position remains stable in this position and larger forces are needed to release the piece from this position.

Figure 4:
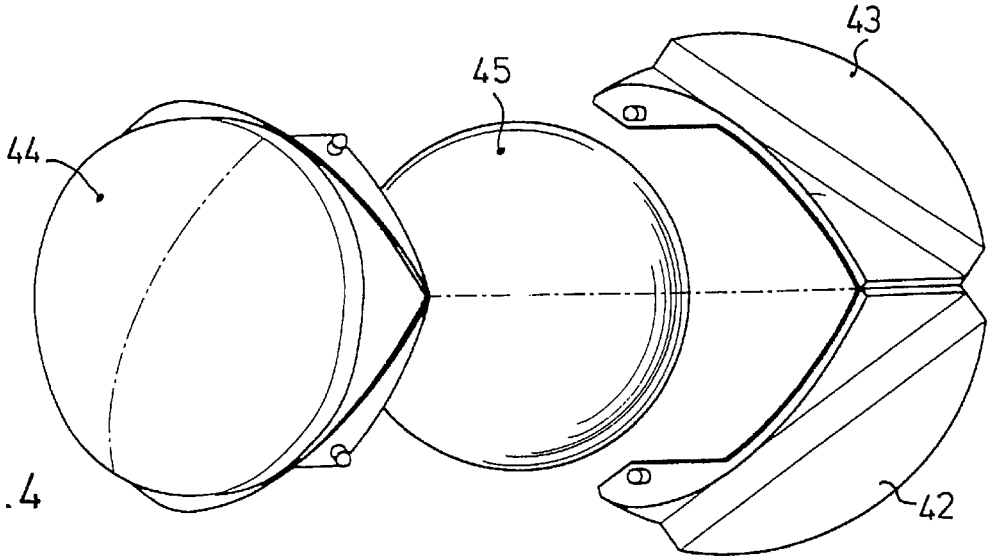
FIG. 4 shows a cutaway view of the piece according to FIG. 3.

In FIG. 4 a schematically cutaway view of a playing dice with a stability-enhancing metal ball 45 and (three of the four) faces 42, 43 and 44 can be seen.

Figure 5:
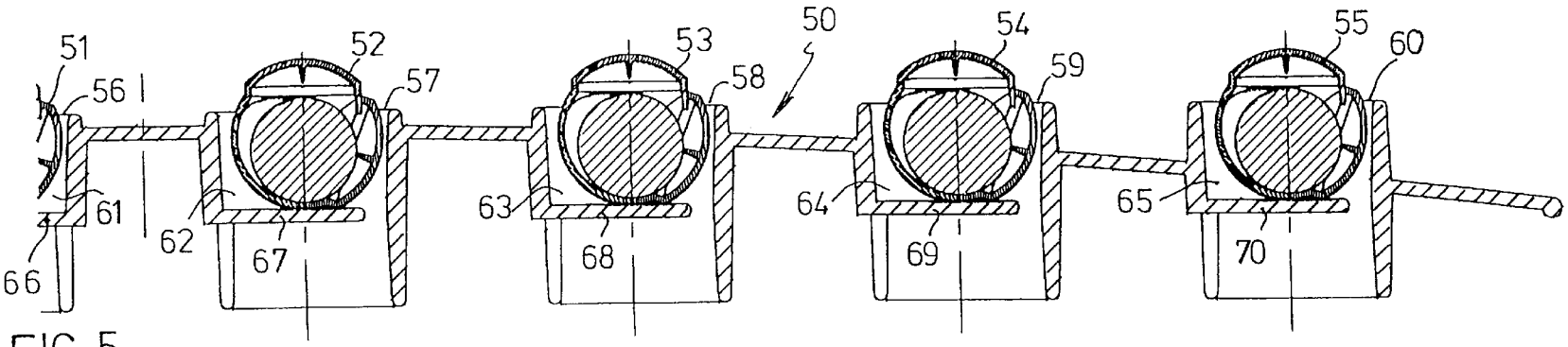
FIG. 5 shows a cross section of an exemplary embodiment of an assembly of games' board and playing dice according to the invention.

The piece according to the invention is eminently suited for use as a dice in dice games, but can just as well be used in board games such as draughts, go, othello and the like. For this purpose the invention provides an assembly of games' board 50 and a number of playing dice 51, 52, 53, 54 and 55 according to the invention (see FIG. 5). The games' board contains a number of playing surfaces 56, 57, 58, 59 and 60, each playing surface containing a recess 61, 62, 63, 64 and 65, respectively, for rotatingly and retainingly receiving the playing dice. In the embodiment shown in FIG. 5 the recesses are cylindrical and contain a carrying part 66, 67, 66, 69 and 70 for carrying a playing dice. Depending on the rules of the game in question a particular board game can be played in that a player can turn up the color or sign belonging to him by rotating with a finger. Certain faces can have a neutral color or a neutral sign that does not belong to any player.

An additional advantage of the dice according to the invention is that all four of the surfaces, provided for example with colors, are perceptible from large optical angles, so that a player can quickly judge in which direction the dice should be rotated in order to bring his or her dice in the correct position.

Figure 6:
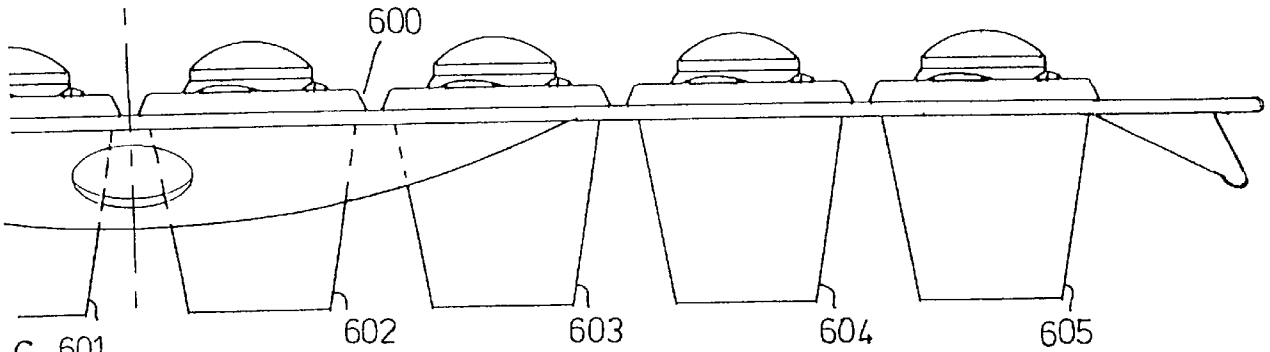
FIG. 6 shows a side view of an alternative assembly according to the invention.
Figure 7:
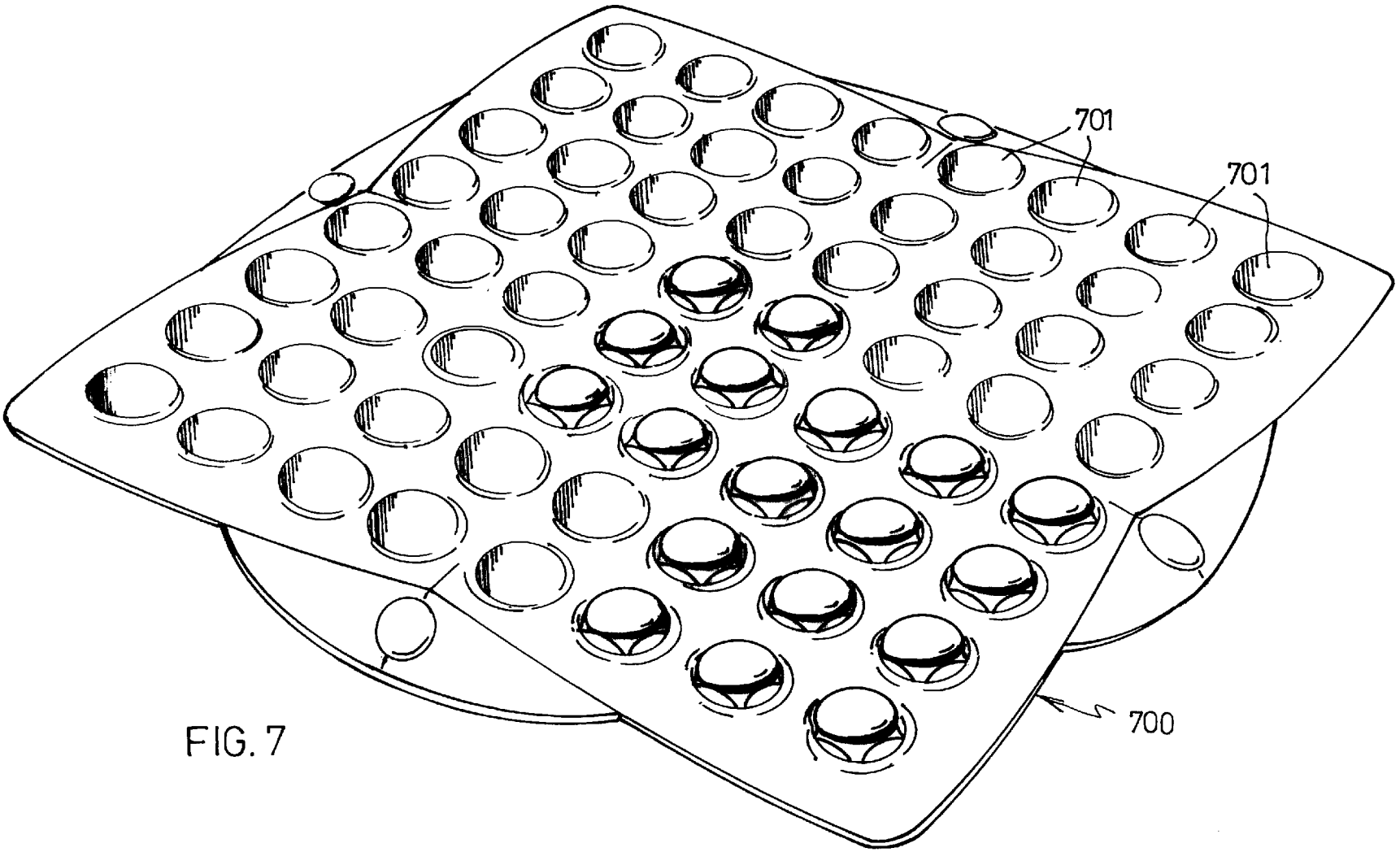
FIG. 7 shows a perspective view of another alternative assembly according to the invention.

In order to be able to stably receive playing dice of different dimensions it is preferable if the recesses 601, 602, 603, 604 and 605 of a games' board 600 (see FIG. 6) have a conical shape. Depending on the degree of tapering of the cone, a carrying part, as described in the previous embodiment, can be omitted. Alternatively, the playing surfaces 701 of a games' board shown in perspective in FIG. 7 can have the shape of a segment of a sphere or the shape of a symmetrical tetrahedron.

Games' boards according to the present invention can be manufactured separately and relate to a particular game which can be played with playing dice or possibly other pieces already in the player's possession.

Figure 8:
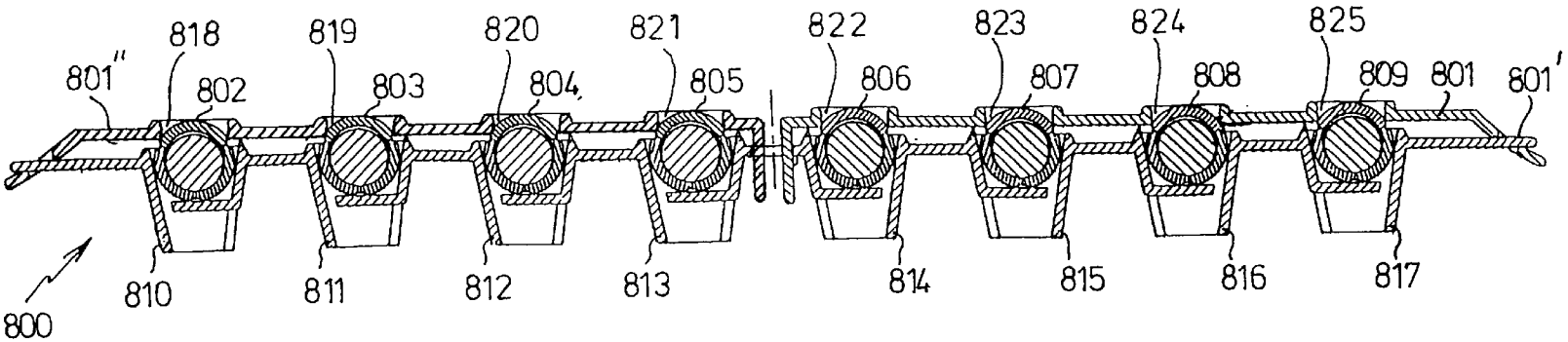
FIG. 8 shows a cross section of an assembly of a games' board and playing dice, according to the present invention, in which the playing dice are retainable in the games' board.

In FIG. 8 an embodiment of an assembly 800 of a games' board with parts 801, 801', 801" and playing dice 802 to 809 is shown schematically in cross section, the playing dice being rotatably and retainably received in this case in the conical recesses 810 to 817 of the games' board part 801". Because the playing dice are retained they cannot be removed out of or from the games' board, as a result of which this assembly is eminently suited for use as a travel game. To be able to handle the playing dice, the games' board has access openings 818 to 825 for the playing dice. In the example given in FIG. 8 the games' board has a base part 801' on to which two lid parts 801, 801" can be removably snapped in order to retain the playing dice. In this way it is possible to place other playing dice in the games' board by removing the lid parts 801, 801". Naturally it is also possible to use a different number of lid parts or to attach the lid parts to the base part.

What is claimed is:

1. A die or dice, comprising an outer surface with four faces, each face having at least in part the shape of a segment of a sphere wherein each face having a surface area which is less than half the surface area of an entire sphere, and each face carrying identifying indicia, the center of each face being located on the angular points of a symmetrical tetrahedron, any three of the four faces, which faces are situated mutually in pairs adjacent one other, touching one other at a trihedral point, said trihedral point being situated diametrically with regard to the fourth face, and said die being provided on the outer surface with four support positions for the die, each support position having as a center said trihedral point, said faces being arranged contiguously so as to form a single generally spherical body.

2. A die or dice according to claim 1, further provided with an inner cavity, the (die or dice) having an inner surface, and with a separate stability-enhancing element, which is movably placed in the inner cavity, the inner surface defining the inner cavity and being provided with receiving means for receiving the stability-enhancing element in a number of stable positions, the number of stable positions being equal to the number of faces, and each stable position being diametrically situated with regard to the face in question.

3. A die or dice according to claim 1, the outer surface of the die or dice being provided with intersecting, slot-shaped recesses, which separate the faces from each other, the recesses intersecting each other on the trihedral points for shaping the support positions.

4. A die or dice according to claim 1, each support position being formed by a flat face shaped on the die or dice.

5. A die or dice according to claim 1, the identifying index of each face being a color.

6. A die or dice according to claim 2, the receiving means on the inner surface being inwardly-directed projections.

* * * * *